US006510943B2

(12) United States Patent
Okin et al.

(10) Patent No.: US 6,510,943 B2
(45) Date of Patent: Jan. 28, 2003

(54) DUAL ARTICLE PACKAGE

(75) Inventors: Matthew Scott Okin, Cresskill, NJ (US); Josephine Telesca, Trumbull, CT (US); Raymond Michael Flaig, Stamford, CT (US)

(73) Assignee: Unilever Home & Persona Care USA, division of Conopco, Inc., Greenwich, CT (US)

( * ) Notice: Subject to any disclaimer, the term of this patent is extended or adjusted under 35 U.S.C. 154(b) by 26 days.

(21) Appl. No.: 09/796,135

(22) Filed: Feb. 28, 2001

(65) Prior Publication Data

US 2002/0117409 A1 Aug. 29, 2002

Related U.S. Application Data

(60) Provisional application No. 60/229,439, filed on Aug. 31, 2000.

(51) Int. Cl.[7] ..... B65D 77/00
(52) U.S. Cl. ..... 206/216; 229/120.18
(58) Field of Search ..... 206/216, 525.1, 206/526, 730, 731; 229/120.18

(56) References Cited

U.S. PATENT DOCUMENTS

| | | | | | |
|---|---|---|---|---|---|
| 1,483,195 | A | * | 2/1924 | Pinkerton | 206/362.2 |
| 1,550,687 | A | * | 8/1925 | Gibson | 206/337 |
| 2,774,468 | A | * | 12/1956 | Rous | 206/427 |
| 2,926,781 | A | | 3/1960 | Dickhens et al. | |
| 3,111,253 | A | * | 11/1963 | Hennessey | 206/229 |
| 3,724,650 | A | * | 4/1973 | Forbes, Jr. | 206/216 |
| 3,812,957 | A | * | 5/1974 | Forbes, Jr. | 206/216 |
| 4,294,397 | A | | 10/1981 | Kohler | |
| 4,874,087 | A | * | 10/1989 | Mayne | 206/361 |
| 4,919,302 | A | | 4/1990 | McPherson | |
| 5,170,934 | A | | 12/1992 | Lemoine | |
| 5,609,248 | A | | 3/1997 | Rohrbough et al. | |
| 5,630,544 | A | | 5/1997 | Shane | |
| 5,775,574 | A | | 7/1998 | Whitnell | |
| 5,890,648 | A | | 4/1999 | Cai | |
| 5,996,797 | A | | 12/1999 | Flaig | |

* cited by examiner

*Primary Examiner*—David T. Fidei
(74) *Attorney, Agent, or Firm*—Milton L. Honig

(57) ABSTRACT

An outer package is provided for strapping together at least two different articles. The package is a unitary cellulosic board forming primary and secondary hollow cavities of unequal volume, the primary cavity having opposite openings on first and second ends, the secondary hollow cavity having opposite left and right ends each coverable by a closure wall when folded into a closed position. A pair of article anchoring apertures are formed in the floor wall to secure any article held within the primary cavity. A blank is also described which when assembled through adhesive securement of head and tail terminal panels forms the outer package.

8 Claims, 2 Drawing Sheets

DUAL ARTICLE PACKAGE

This application claims the benefit of Provisional Application No. 60/229,439, filed Aug. 31, 2000.

BACKGROUND OF THE INVENTION

1. Field of the Invention

The invention concerns a carton capable of strapping together two related articles of different size and outer wall strength.

2. The Related Art

Food, health and beauty products are sometimes promoted as bonus or club packs. Two related consumer articles are wrapped together for sale. The combination price will be lower than each of the separate articles. Consumers are thereby provided with an incentive to purchase and utilized the co-packaged bonus item. For example, toothpaste and toothbrush may be co-promoted.

Often the two articles are placed in their normal single-sale package and joined together by a wrap which usually is no more than shrink-wrap transparent plastic. Shrink-wrap has an economic advantage but may not always be suitable. Aesthetics are lacking and the strength of the film may be inadequate for larger articles, unusually shaped articles and/or heavy items.

Accordingly, it is an object of the present invention to provide an outer package for joinder of at least two different articles which may be presented for sale in consumer food, health and beauty outlets.

Another object of the present invention is to provide an outer package which is economical, easy to assemble, strong and can join at least two different articles which may have different weights, geometry and be unsuitable for shrink-wrapping.

SUMMARY OF THE INVENTION

An outer package is provided for joining of at least two different articles which includes a unitary cellulosic board forming primary and secondary hollow cavities of unequal volume, the primary hollow cavity having opposite openings on first and second ends, the secondary hollow cavity having opposite left and right ends with respective closure walls that when folded into a closed position cover each of the left and right ends.

A blank for an outer package is also provided which includes:

- a central wall panel;
- a side wall panel which includes an elongated area formable into a flanking wall of a secondary cavity and a side wall formable into a primary cavity, the width of the side wall being shorter than that of the elongated area; and
- a floor wall panel, wherein the side wall panel and floor wall panel adjoin the central wall panel on opposite edges thereof.

BRIEF DESCRIPTION OF THE DRAWING

Further objects, features and advantages of the present invention will become more evident through consideration of the following drawing in which.

DETAILED DESCRIPTION OF THE INVENTION

Now there has been developed from a single cellulosic blank, an outer package for holding in saddled relationship a first and second pre-packaged consumer article. Although not intended to be limited to any particular article, the present invention has special concern with combining a hard plastic towelette dispensing container and a refill soft-walled pouch of towelettes which may be fitted into the hard case dispenser. Different outer dimensions of the hard case dispenser and soft-walled pouch necessitated an outer wrapper accommodating the different geometries, hardness and retail shelf-displayability of the combined promotion articles.

Figure 1:
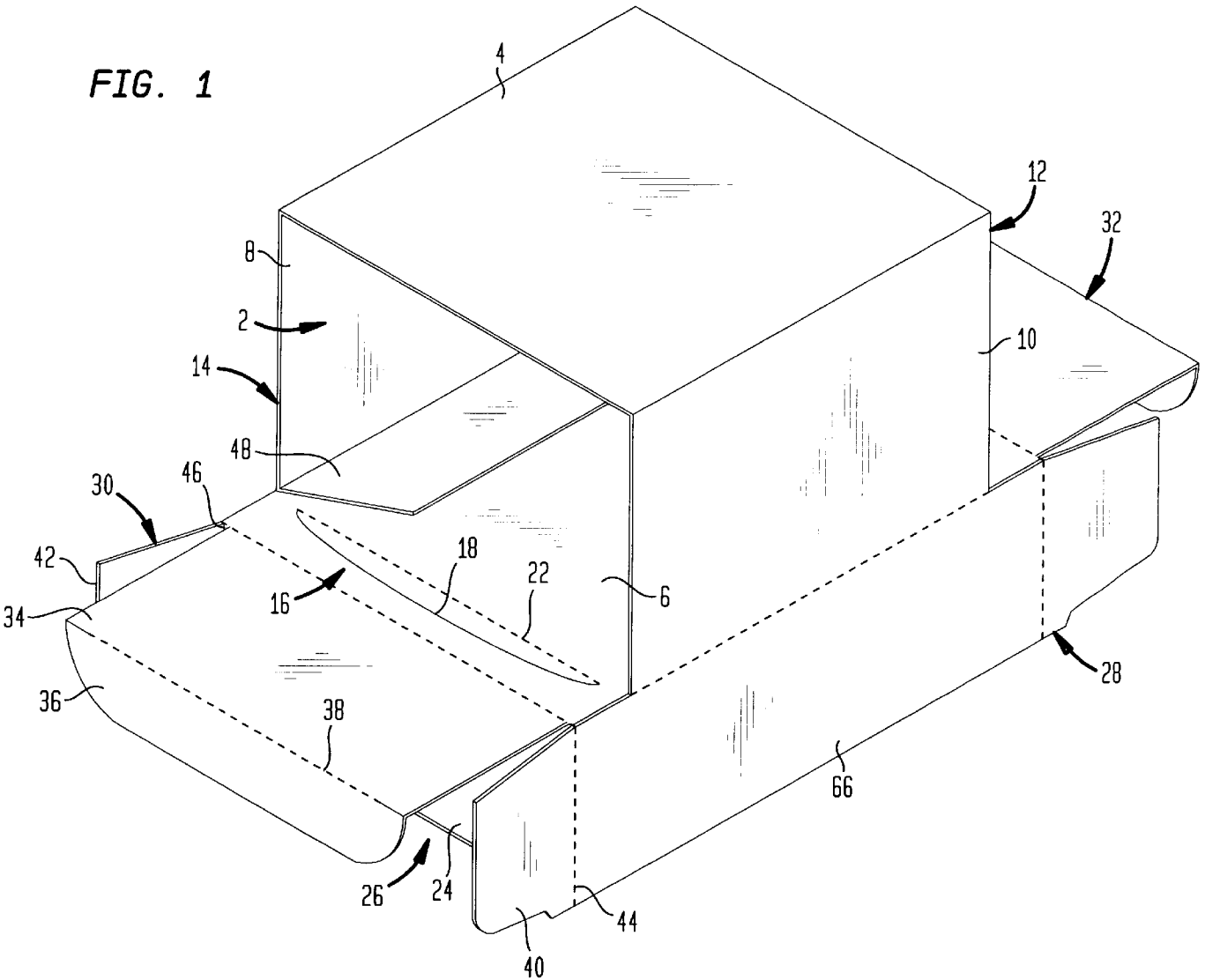
FIG. 1 is a plan perspective view of the assembled outer package.

The present invention achieves the desired result through use of a single cellulosic blank which is folded and glued along only two flaps. FIG. 1 illustrates the assembled blank. A primary cavity 2 houses a rigid plastic dispensing case (not shown) of a type described in pending U.S. Patent Application Serial No. 60/200,802 (Flaig et al.) serving as a towelette dispenser, herein incorporated by reference. In view of the relatively rigid construction of the hard case, neither the walls of the cavity nor the cavity itself need cover all of the hard case. It is only necessary to have 80%, and perhaps no more than 50% or even 20% circumferencing the hard case article. Primary cavity 2 is constructed from a ceiling wall 4, a floor wall 6 and a pair of side walls 8, 10. Openings 12, 14 on opposite ends of the primary hollow cavity permit the hard dispensing case or other article to be easily removed by a purchaser of the product.

An anchoring aperture 16 is provided near both of the opposite opening ends 12, 14. The anchoring aperture is formed by a bendable flap 18 partially detachable from the floor wall by breakage of a perforated line 20. Opposite the perforation length is a crease line 22 along which the flap can pivot. The anchoring apertures ensure that the hard case will not slip out from its protective cavity.

It is particularly preferred that the floor wall 6 have a length, and therefore also an area, greater than that of a ceiling wall 4. This arrangement minimizes the amount of packaging material necessary for the cellulosic blank and also allows a consumer to better view the dispensing case or other article held within the primary cavity.

A secondary hollow cavity 24 is formed underneath the primary cavity. Left and right ends 26, 28 define opposite terminals of the secondary hollow cavity. A pair of closure walls 30, 32 cover each of the left and right ends when the closure walls are folded into their closed position. Closure walls 30, 32 are each respectively pivotally connected to respective opposite edges of floor wall 6. Each closure wall includes a panel 34 with an attached under flap 36 separated from the panel by a crease line 38. Left and right end flaps 40, 42 are foldable along respective crease lines 44, 46 to augment the closure walls thereby preventing an article falling out from within the secondary cavity.

Although not at all to be considered limiting, an article most suitable for placement within the secondary cavity is a flexible walled pouch formed of a plastic foil based on such polymers as polyethylene, polypropylene, polyester, polyamide and combinations of these materials in laminate layers. Wet towelettes are sealably contained in such pouches as described in U.S. Pat. 5,996,797 (Flaig et al.) herein incorporated by reference. Preferably the outer package of the present invention will neither be a plastic pouch nor a hard plastic case but rather be constructed of a cellulosic material. Particularly preferred is a carton of paperboard or cardboard.

For purposes of assembly, the outer package will be furnished with head and tail terminal panels 48, 50 and a side wall panel 51 defining side wall 8 and elongate area 66. One of the two parallel flanking walls of the secondary cavity is defined by area 66. Assembly of the outer package is accomplished as follows. The blank is folded inward at right angles along a set of fold lines 52, 54, 56, 58, 60 and 62. Completion of these folds will orient head terminal panel 48 to lie juxtaposed to floor wall 6. With the aid of adhesive, the panel and wall combination will be sealingly secured. Tail terminal panel 50 having been orthogonally bent along fold line 64 will lie adjacent the elongated area 66. A film of adhesive secures tail terminal panel 50 to an inner surface of the elongated area.

Figure 2:
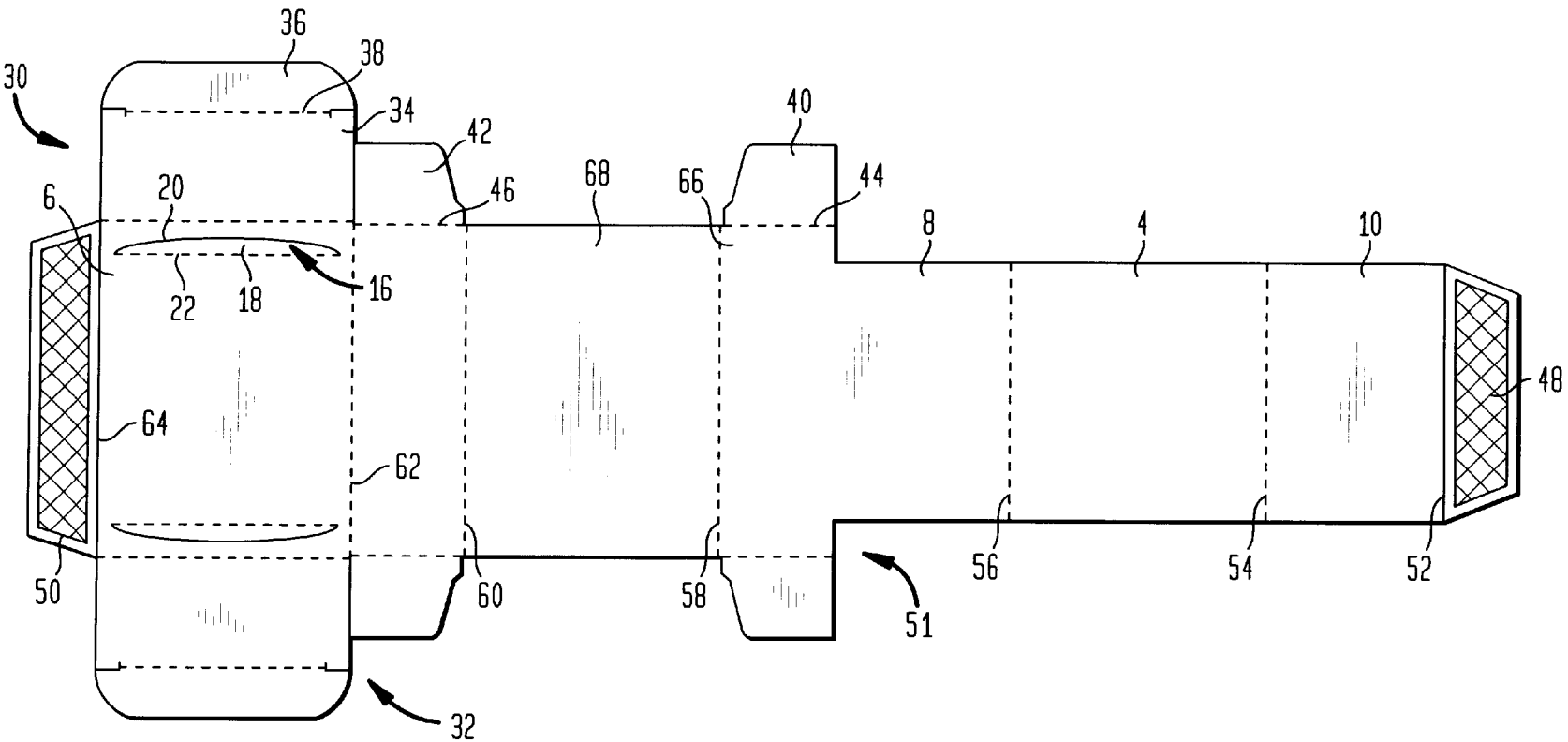
FIG. 2 is an unfolded blank of a carton forming the outer package of FIG. 1.

A further aspect of the present invention is that of a cellulosic blank for an outer package. FIG. 2 best illustrates the blank. It includes a central wall panel 68. Side wall panel 51 and floor wall panel 6 join the central wall panel at opposite edges thereof. Other panels and features have already been described with respect to the assembled outer package.

The foregoing description and examples illustrate selected embodiments of the present invention. In light thereof variations and modifications will be suggested to one skilled in the art, all of which are within the spirit and purview of this invention.

What is claimed is:

1. An outer package for joining of at least two different articles comprising:

a unitary cellulosic board forming primary and secondary hollow cavities of unequal volume;

the primary hollow cavity having opposite openings on first and second ends, the primary cavity comprising a ceiling wall, a floor wall and two side walls, the floor wall having an article anchoring aperture near each of the first and second ends, the aperture being formed with a bendable flap; and the secondary hollow cavity having opposite left and right ends with respective closure walls that when folded into a closed position cover each of the left and right ends.

2. The package according to claim 1 wherein the primary cavity is larger than the secondary cavity.

3. The package according to claim 1 wherein the floor wall has a length greater than a length of the ceiling wall.

4. The package according to claim 1 wherein the floor wall of the primary cavity is a wall common to the secondary cavity.

5. The package according to claim 1 wherein the closure walls are pivotally connected to respective opposite edges of the floor wall and each closure wall comprises a panel attached to the floor wall, and an under flap being separated by a crease line from the panel.

6. A blank for a package comprising:

a central wall panel;

a side wall panel which includes an elongated area formable into a flanking wall of a secondary cavity and a second side wall panel formable into a primary cavity, the width of the second side wall panel being smaller than that of the elongated area; and a floor wall panel, wherein the side wall panel and floor wall panel adjoin the central wall panel on opposite edges thereof, the floor wall panel including a pair of anchoring apertures formed with a bendable flap along a crease line, the apertures being at opposite ends of the floor wall panel.

7. An outer package for joining of at least two different articles comprising:

a unitary cellulosic board forming primary and secondary hollow cavities of unequal volume;

the primary hollow cavity having opposite openings on first and second ends, the primary cavity comprising a ceiling wall, a floor wall and two side walls, the floor wall having an article anchoring aperture near each of the first and second ends, the apertures being separate from and parallel to one another and oriented perpendicular to a length of the floor wall; and the secondary hollow cavity having opposite left and right ends with respective closure walls that when folded into a closed position cover each of the left and right ends.

8. The package according to claim 7 wherein the primary cavity is larger than the secondary cavity.

* * * * *